US007140943B1

(12) United States Patent
Hawkins

(10) Patent No.: US 7,140,943 B1
(45) **Date of Patent: *Nov. 28, 2006**

(54) BOBBLE HEAD AND CONTAINER

(76) Inventor: Victor Jonathan Hawkins, 2462 Wine Country Ave., Napa, CA (US) 94558

( * ) Notice: Subject to any disclaimer, the term of this patent is extended or adjusted under 35 U.S.C. 154(b) by 222 days.

This patent is subject to a terminal disclaimer.

(21) Appl. No.: 10/778,860

(22) Filed: Feb. 13, 2004

(51) Int. Cl.
*A63H 3/00* (2006.01)
*A63H 3/36* (2006.01)
*B65D 73/00* (2006.01)

(52) U.S. Cl. ..... 446/74; 446/391; 206/457

(58) Field of Classification Search ..... 446/71–74, 446/97, 99–100, 321, 330, 351, 337, 338, 446/376, 379, 380, 381, 384, 486, 137, 139, 446/475, 391; 206/216, 217, 457; 215/228, 215/230; 40/310, 311, 411, 421, 424; 221/24; 222/78

See application file for complete search history.

(56) References Cited

U.S. PATENT DOCUMENTS 1,660,085 A * 2/1928 Elnain ..... 222/78
3,465,474 A * 9/1969 Gardel et al. ..... 446/351
5,651,475 A * 7/1997 Fenton ..... 221/24
5,738,232 A * 4/1998 Roberts et al. ..... 215/228
5,850,940 A * 12/1998 Sloan et al. ..... 222/78
6,029,855 A * 2/2000 Adams ..... 222/78
6,511,359 B1 * 1/2003 Lui ..... 446/321
6,739,930 B1 * 5/2004 Cheng et al. ..... 445/24
2001/0010995 A1 * 8/2001 Nelson et al. ..... 446/490

* cited by examiner

*Primary Examiner*—Eugene Kim
*Assistant Examiner*—Alyssa M. Lowen
(74) *Attorney, Agent, or Firm*—Risto A. Rinne, Jr.

(57) ABSTRACT

An apparatus for containing a substance includes a container and a bobble head that is attached to the container. An opening is provided in the container to provide access to the substance. The bobble head is removed to access the opening and the substance. A first modified design includes an upper half and a lower half that are separable and, when separated, provide the opening and access to the fluid in the lower half. A second modified design includes a permanently attached bobble head and a separate opening and screw on lid. A third modified design includes a hex shaped key and a fourth modified design includes a sleeve attached to a bobble head that is adapted to fit over a pre-existing cap.

16 Claims, 6 Drawing Sheets

BOBBLE HEAD AND CONTAINER

This application is related to a prior patent application Ser. No. 10/702,789 entitled, "Bobble Head Fluid Container" by the same inventor, that was filed on Nov. 5, 2003.

BACKGROUND OF THE INVENTION

1. Field of the Invention

The present invention, in general, relates to containers and, more particularly, to a container that includes a bobble head.

A bobble head is a well known type of device that supports a simulated head atop a lower member (i.e., the rest of a body) to create a figurine, either human or otherwise. The typical bobble head includes a spring that is disposed intermediate the head and the lower member. The spring is attached at a lower end thereof to an upper part of the body and at an upper end thereof to the simulated head.

The spring suspends the simulated head above the body and allows the head to shake slightly up or down, tilt from side to side, forward and back, and even to rotate slightly about a center longitudinal axis (i.e., to turn from right to left). The head wobbles or "bobbles" in response to movements that are incurred by the head or by the body. The spring transfers energy (kinetic) between the body and the head so as to impart a range of motion to the head relative to the body that appears to bring a level of animation to the head. This increases both the realism and novelty of the figurine.

Figurines that include a bobble head are well known devices. They are sold for use both as toys and as novelty items. They are sometime even given away for free as a promotional item. For example, it is not uncommon to see a bobble head figurine that resembles that of a popular character commonly associated with a fast food restaurant atop a dashboard of an automobile. The bobbling of the head amuses the driver and the caricature itself reminds others of the particular restaurant, thereby serving an advertising function for the restaurant.

However, the utility of the bobble head figurine is limited. It is desirable to be able to provide a container that is adapted to hold a fluid for consumption or any other product that also includes a bobble head. This would help in marketing (advertising) as was mentioned above while making utilitarian use of the figurine.

The term bobble head is not limited to a representation of a head only but can include any structure of interest, for example, a football, baseball, basketball, soccer ball, tennis ball, ping pong ball, pumpkin, Christmas decoration or tree, cartoon caricature, animal, etc. The term bobble head is herein intended to include any type of an ornamental design that is supported by an upper half of a spring, the lower half being attached to a base portion, and which can tilt with respect to a center vertical axis in any direction along a 360 degree arc extending radially around the center vertical axis.

There are many types of containers that would benefit from a bobble head. Sometimes, these containers will contain something for human or animal consumption, other times they will not. For example, any beverage can be housed in such a container as can bubble bath, bath oils or crystals, or virtually any other product. The bobble head would add to the value of the product and even encourage reuse, thereby providing the unexpected benefit of conservation of resources through recycling and reuse.

As a bobble head is adapted to fit atop various containers, problems arise. How can a bobble head be integrated into a lid (that is adapted to fit the container) that allows for sealing of the container, opening of the container, and later re-sealing? Or how can a bobble head be easily attached to a top of a container, and then removed as needed?

Accordingly, there exists today a need for a bobble head container that is adapted to hold a product and which can help ameliorate the above-mentioned difficulties.

Clearly, such an apparatus would be a useful and desirable device.

2. Description of Prior Art

Bobble head devices as well as drinking containers are, in general, known but not together. For example, the following patents describe various types of these devices:

U.S. Pat. No. 2,893,591 to Barradas, Jul. 7, 1959;
U.S. Pat. No. 4,815,999 to Ayon et al., Mar. 28, 1989;
U.S. Pat. No. 4,816,000 to Hsu, Mar. 28, 1989;
U.S. Pat. No. 4,923,084 to Forbes, May 8, 1990;
U.S. Pat. No. 5,162,013 to von Mohr, Nov. 10, 1992;
U.S. Pat. No. 5,277,646 to Fekete et al., Jan. 11, 1994;
U.S. Pat. No. 5,636,740 to Finkiewicz et al., Jun. 10, 1997;
U.S. Pat. No. 6,382,440 to Brant et al, May 7, 2002;
U.S. Pat. No. 6,505,734 to Su, Jan. 14, 2003;
U.S. Pat. No. 6,511,359 to Lui, Jan. 28, 2003; and
U.S. Design Pat. No. 282,339 to Wei, Jan. 28, 1986.

Also, U.S. Pat. No. 6,494,056 to Roth, et al, that issued Dec. 17, 2002, appertains to a thermal energy storing device that was used on an apparatus manufactured or marketed by Cool Gear International, Inc. Duxbury, Mass. 09332, telephone 1 800 386-3374 and covered by U.S. Design Pat. No. 472,563 for a refreezable beverage cooler. This apparatus includes a container with a conduit extending through a head. The head is supported by a spring and can be urged up or down longitudinally but the conduit prevents it from bobbling (i.e., having a full range of side to side tilting) as is characteristic of a true bobble head. It is also not possible to acquire any fluid from the container without having to tilt the container upside down. This causes the head to move longitudinally and strike the mouth of the person using the device, clearly an undesirable condition.

While the structural arrangements of the above described devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a bobble head container that is adapted to contain a substance and which has a bobble head attached thereto.

It is also an important object of the invention to provide a bobble head container that is adapted to contain a fluid and which has a bobble head attached thereto.

Still yet another object of the invention is to provide a bobble head container that is adapted to contain a substance and which has a bobble head attached thereto and which can be refilled with an additional quantity of the substance.

A first further important object of the invention is to provide a bobble head container that is adapted to contain a substance and which has a bobble head attached thereto and which includes a top that can be opened to remove (i.e., pour out) some of the substance from the container or to add more of the substance to the container.

A second further important object of the invention is to provide a bobble head container that can be separated into an upper and a lower portion sufficient to add or remove a substance from the lower portion of the container.

A third further important object of the invention is to provide a bobble head container that is adapted to support a bobble head on a threaded lid that is hidden from view.

A fourth further important object of the invention is to provide a bobble head container that includes a bobble head that is disposed above a threaded cap, and wherein the bobble head is adapted to be urged downward to engage with the cap sufficient to permit loosening or tightening of cap according to the direction the bobble head is rotated.

A fifth further important object of the invention is to provide a bobble head container that includes a bobble head that can be slipped over a cap (i.e., a lid) of an existing container.

A sixth further important object of the invention is to provide a bobble head container that includes a bobble head that can be slipped over a cap (i.e., a lid) of an existing container and remain in place, for example by a friction fit until it is desirable to remove the bobble head, at which time the bobble head can be urged off of the cap to allow access to the cap and normal functioning thereof.

Briefly, a bobble head container that is constructed in accordance with the principles of the present invention has a container and a bobble head affixed to a top of the container. The container is adapted to contain a substance for use or a fluid for consumption by a human. The container includes a lid or a cap or, according to a modification, is separable into two halves, an upper half and a lower half. When either the lid or cap are used, the bobble head is disposed above the lid or cap. When the container is separable the upper half serves as a lid and the lower half serves as the container for the substance. According to a preferred modification, the lid can be unscrewed and removed apart from the container if the bobble head is depressed sufficient to engage a geometric structure (i.e., a key) on the bobble head with a matching geometric structure (key) on the lid. The bobble head portion is removed to allow access of the substance. The container is tilted to pour out the substance, much the same as a glass is tilted to pour out its contents or an opened jar is tilted to pour out its contents. According to a second preferred modification, a friction fit extension of the bobble head slips over a pre-existing cap sufficient to secure the bobble head to it. To open the cap, the bobble head is first slipped off of the cap and then the cap is used in a normal fashion.

DETAILED DESCRIPTION OF THE INVENTION

Figure 1:
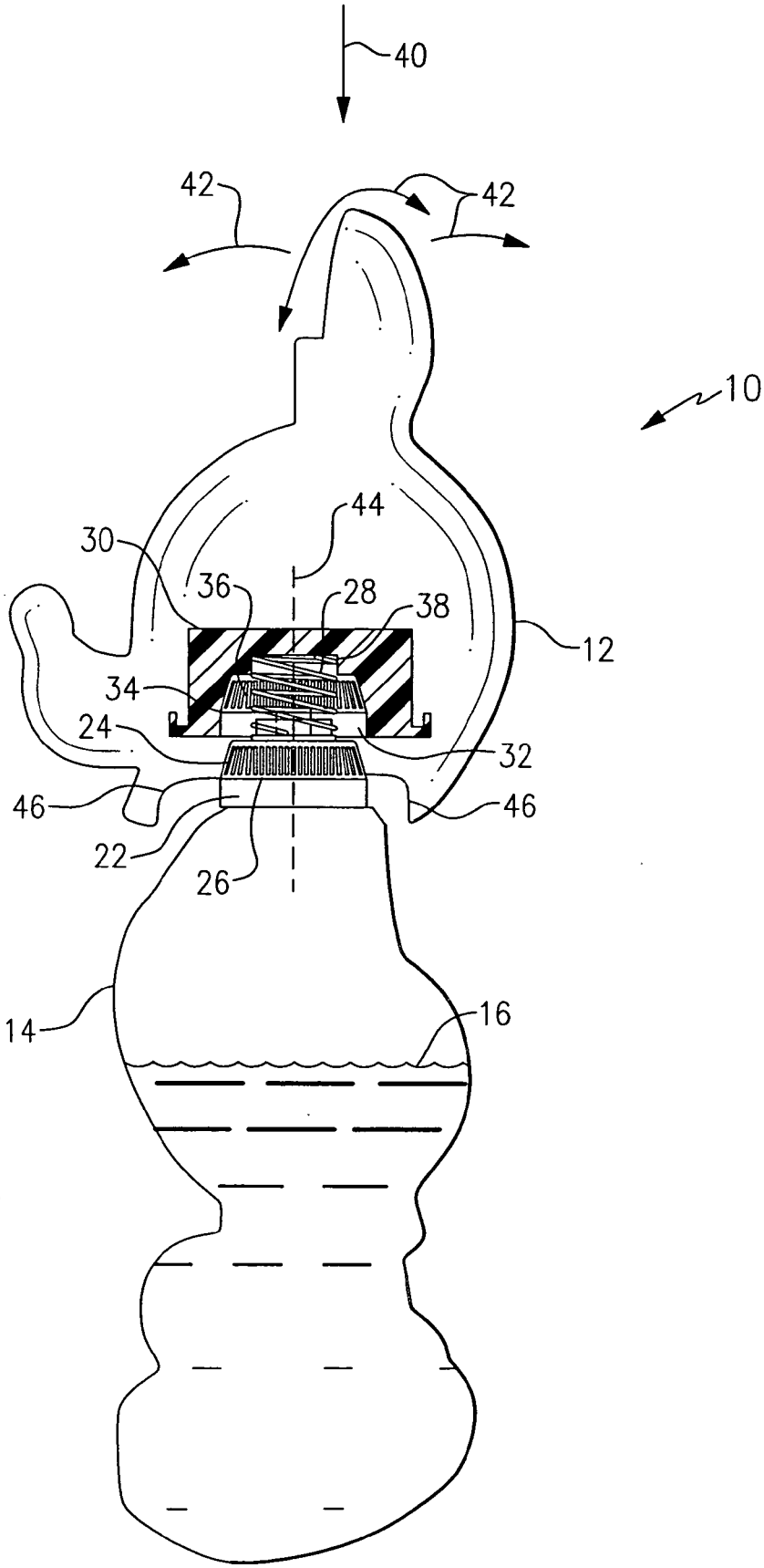
FIG. 1 is a side view of bobble head container, shown partially in cross-section.

Referring to FIG. 1 is shown, a bobble head container, identified in general by the reference numeral 10.

The bobble head container 10 includes a bobble head 12 and a container 14. The example shown resembles a caricature of a well known cartoon mouse, although any appearance can be used. For example, the bobble head container 10 may resemble a man, woman, child, infant, baby, animal, comic or cartoon character, movie character, monster, mythological creature, sports personality, etc.

Regardless of the appearance, the bobble head container 10 will always include the bobble head 12 (in some form) and the container 14 (in some form). The shape and size of the bobble head 12 and of the container 14 will vary, as desired.

The bobble head 12 and the container 14 of the bobble head container 10 combine to produce an overall appearance of a figurine. The container 14 is hollow and is adapted to contain a substance 16 for human or animal use, including possible consumption. For example, the substance 16 can include any liquid, powder, etc. It can even include a beverage for consumption. The substance 16 can include any preferred fluid in a liquid state, for example, milk, chocolate milk, soda, etc. While it is possible to use the bobble head container 10 with a hot beverage, it is intended primarily for use when the substance 16 is at or below room temperature (i.e., cooled). The substance 16 can include bath crystals, essential oils, dog bones, soap, lotions, anything that presently is sold in the container 14 or which can in the future be placed therein.

A lid 22 is provided that includes interior threads that are adapted to cooperate with corresponding outer threads on top of the container 14. This method of attachment is in general well known and is commonly referred to as a "screw-type of lid".

The lid 22 is provided for access to the interior of the container 14 (i.e., to access an upper opening) and is used to fill the container 14 with the substance 16. The lid 22 is also be loosened to either drink or to drain any remaining quantity of the substance 16 from the container 14, as is appropriate for any particular type of the substance 16.

The lid 22 is unscrewed to either fill or drain the container 14. This is described in greater detail hereinafter.

The lid 22 is circular and includes a tapered side 24. The tapered side 24 leads to a top of the lid 22 that includes a smaller diameter than a lower portion of the lid 22 that attaches to the container 14.

Disposed around an outer circumference of the tapered side 24 are a plurality of alternating raised parallel ridges and depressions 26 (i.e., longitudinal protrusions and recesses) that each include a substantially vertical longitudinal axis thereof and which are disposed at an angle away from vertical that corresponds to the angle of the tapered side 24.

A lower end of a spring 28 is attached to the top of the lid 22. The lower end of the spring 28 is molded into the top of the lid 22 or otherwise secured.

A support member 30 (shown in cross-section) is structurally attached to the bobble head 12 and is capable of supporting the weight of the bobble head 12. The support member 30 may be molded into the bobble head 12 as an integral part thereof or it may be a separate component that is attached to the bobble head 12.

The support member 30 includes a recess 32. The recess 32 includes interior tapered sides 34 that match the tapered sides 24 of the lid 22. The recess 32 is open at a bottom and is closed at a top. Accordingly, a cross-sectional view of the recess 32 includes a shape that approximates a frustum (i.e., a section) of a cone.

An interior circumference of the tapered sides 34 include a plurality of alternating raised parallel ridges and depressions 36 (i.e., longitudinal protrusions and recesses) that are adapted to cooperate with the plurality of alternating raised parallel ridges and depressions 26 of the lid 22.

An upper end of the spring 28 is secured to the support member 30 by inserting it into a recess 38 that is provided in the support member 30.

The upper end of the spring 28 is retained by a friction fit with the recess 38 or it can be molded or attached in other ways, as described hereinafter for both the upper and lower ends thereof.

The spring 28 is sufficiently strong to retain the bobble head 12 in cooperation with the lid 22 and to support the bobble head 12 a small distance above the lid 22 whenever the bobble head 12 is not being urged otherwise by another force (i.e., by the hand of a user—not shown).

To open the lid 22 and gain access to the interior of the container 14 for filling, drinking, or draining of the substance 16, a force is applied by a user in a downward direction as shown by arrow 40. The force must be of sufficient magnitude to compress the spring 28 and urge the bobble head 12 down toward the lid 22.

As the bobble head 12 is urged downward, the plurality of alternating raised parallel ridges and depressions 36 on the interior tapered sides 34 of the support member 30 cooperate and engage with the plurality of alternating raised parallel ridges and depressions 26 of the lid 22, much like the teeth on a pair of gears (not shown) mesh together when brought together (A small rotary movement of the bobble head 12 may be required for proper engagement).

While maintaining downward pressure on the bobble head 12, the bobble head 12 is then rotated in a counter-clockwise direction (looking down on the top of the container 14) to unscrew, loosen, and remove the lid 22 apart from the container 14.

The lid 22, spring 28, support member 30, and bobble head 12 are then removed apart from the container 14 as an integral assembly.

The lid 22 covers the top opening into the container 14. The opening can be used to add a quantity of the substance 16 to an inside of the container 14, refill the container 14 with more of the substance 16 (or a different type of fluid), drink, or drain the remaining quantity of the substance 16 from the container 16.

After the lid 22, spring 28, support member 30, and bobble head 12 have been removed apart from the container 14, the container 14 is tilted to cause the substance 16 to flow out of the top through the opening for consumption.

If the substance were a liquid for human consumption, typically, a user would place his or her mouth proximate the opening prior to tilting the container 14. The substance 16 is then consumed in much the same manner that a fluid is consumed from any other type of container, for example from a glass. If a person wished, an ordinary type of a straw (not shown) could be inserted through the opening and into the container 14 after the lid 22, spring 28, support member 30, and bobble head 12 have been removed.

If the substance 16 has been removed for cleaning purposes, the fluid container 16 and the detached assembly containing the lid 22, spring 28, support member 30, and bobble head 12 are either manually washed or are placed in a dishwasher for cleaning and subsequent reuse.

When the container 16 is either initially filled or refilled with the fluid, the assembly (i.e., the lid 22, spring 28, support member 30, and bobble head 12) is placed atop the container 14. The bobble head 12 is once again urged in the direction of the arrow 40 and is then rotated in a clockwise direction an amount sufficient to tighten the lid 22. Once the lid 22 is deemed to be sufficiently tight as is indicated by a sudden increase in resistance to its continued turning, the force along arrow 40 is removed. Once the force is removed, the spring 28 urges the bobble head 12 away from the lid 22.

In this elevated position, the bobble head 12 can bobble with respect to the lid 22 (and the container 14) as shown by second arrows 42.

The space intermediate the interior tapered sides 34 of the support member 30 and the spring limit the range of motion. The head 12 can bobble (i.e., tilt from side to side) in any direction along 360 degrees of arc rotation radially about a center longitudinal axis 44 of the spring 28.

If the head 12 is twisted, it can also rotate a small amount as permitted by the spring 28 around the center longitudinal axis 44, which equates to a turning of the head 12 from right to left (side to side).

To provide clearance for the bobble head 12 to tilt from side to side (i.e., to bobble), the bottom of the bobble head 12 is provided with a large opening 46 that includes sufficient clearance intermediate the bottom of the bobble head 12 and the outside of the container 14.

Figure 2:
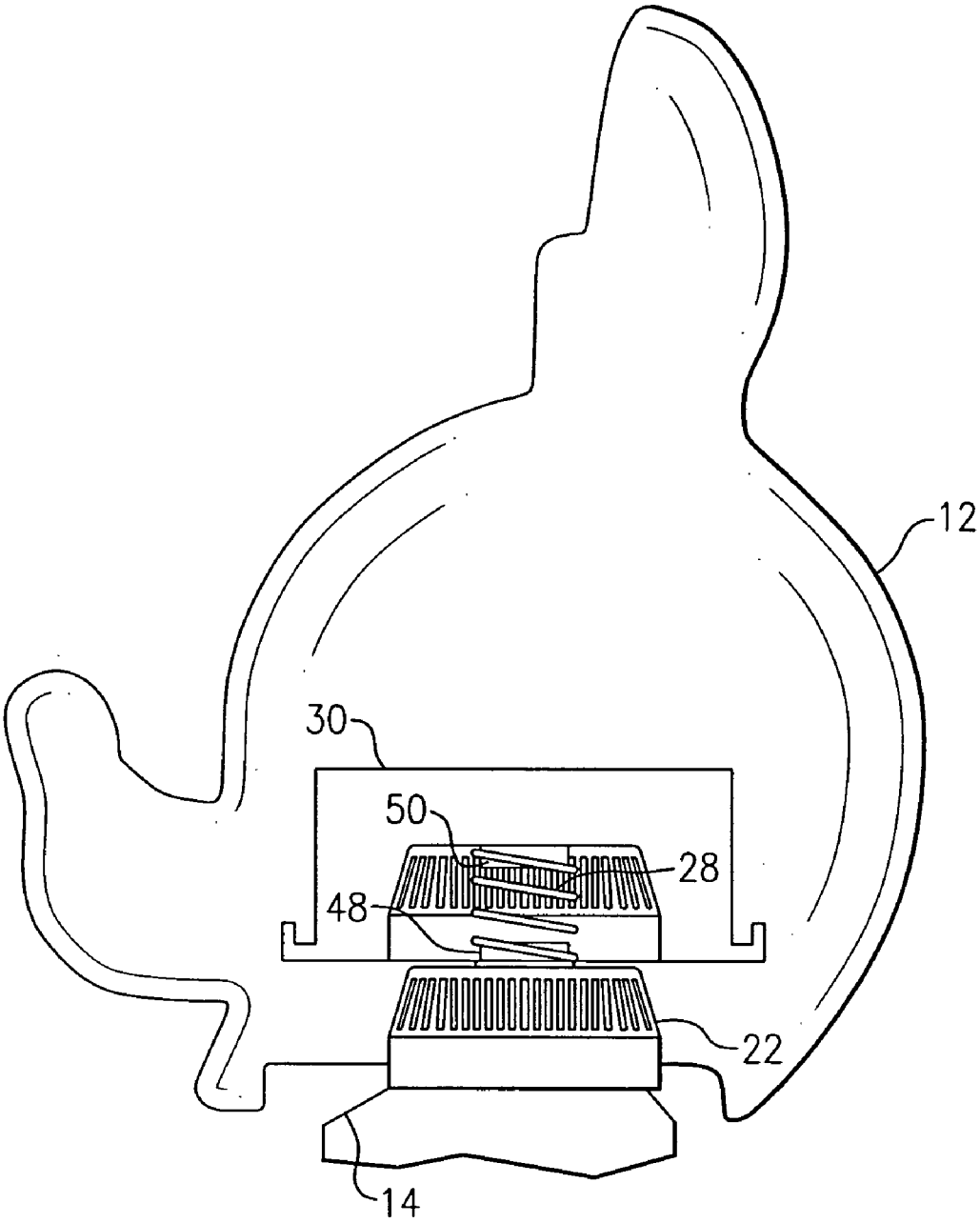
FIG. 2 is a side view of an alternate method of attaching a spring to a lid of the device of FIG. 1.

Referring momentarily to FIG. 2, an alternative method of attaching the lower end of the spring 28 to the top of the lid 22 and to the bobble head 12 is shown and it includes providing a first cylindrical extension 48 that is molded on top of the lid 22 and a second cylindrical extension 50 that is molded inside the bobble head 12 to the support member 30.

Each end of the spring 28 includes a diameter that is preferably slightly less than that of either cylindrical extensions 48, 50. Each end of the spring 28 is forced over each extension 48, 50. The spring 28 ends expand slightly and apply a force to each extension 48, 50 sufficient to retain each end of the spring 28 in position by a friction fit.

Figure 3:
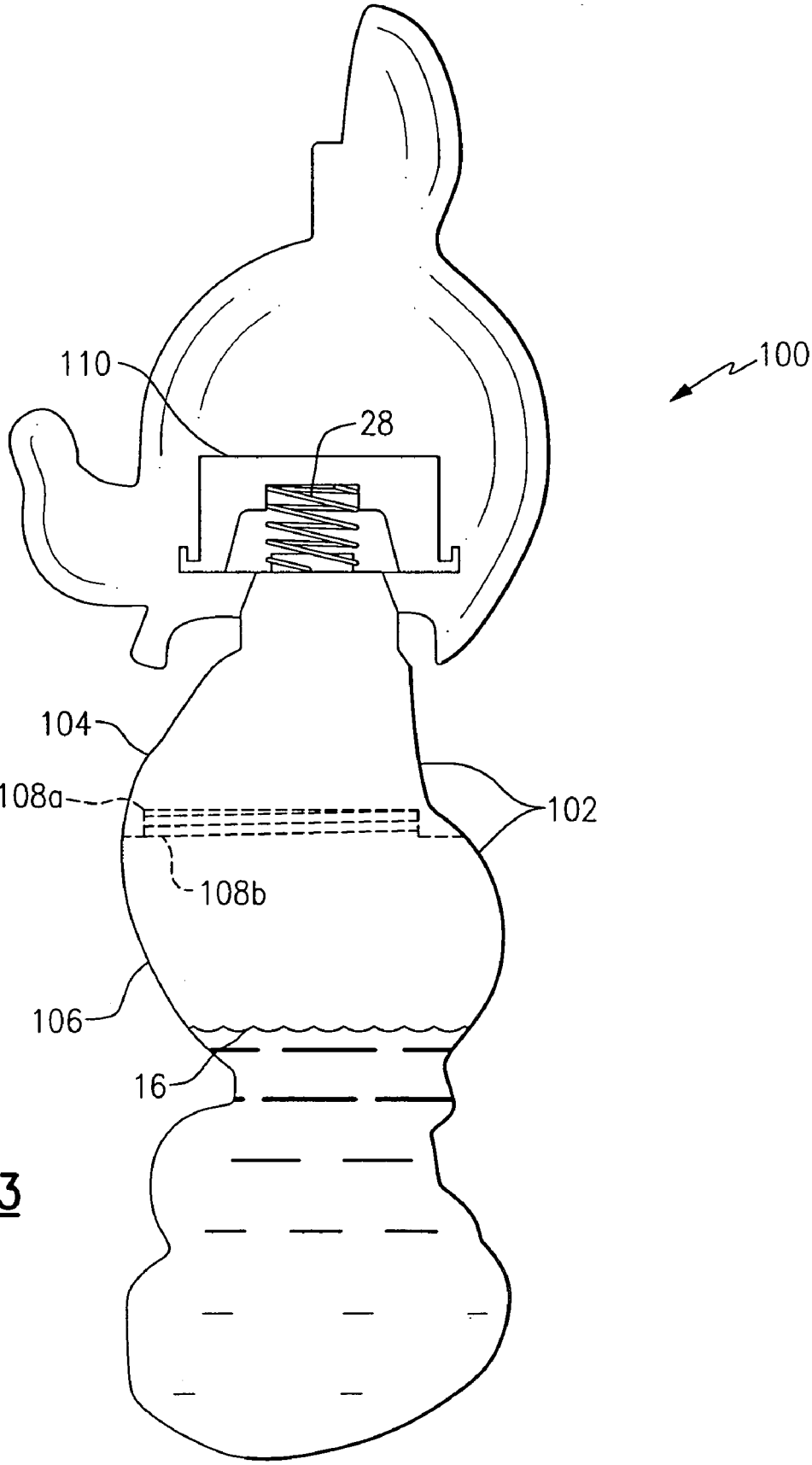
FIG. 3 is a side view of a modified bobble head container, shown partially in cross-section.

Referring now to FIG. 3 is shown a side view of a modified bobble head container 100.

A modified fluid container 102 includes an upper half 104 and a lower half 106. The upper half 104 includes interior threads **108*a* that match with exterior threads 108*b* of the lower half 106**.

The upper half 104 is unscrewed from the lower half 106 to fill, drain, or drink from the lower half 106. An opening is provided at the top of the lower half 106 proximate (i.e., inside) the exterior threads **108*b* of the lower half 106**.

The upper half 104 is sealed above the interior threads **108*a* and thereby provides a seal that contains all of the substance 16 in the lower half 106**.

The spring 28 is attached at the top to a modified support member 110. The spring 28 is attached at the bottom to an upper portion of the upper half 104.

The modified support member 110 does not need to include any protrusions (ridges) or recesses. To remove the upper half 104, the upper half 104 itself is grasped and is rotated counterclockwise with respect to the lower half 106 until it is free and separate. To tighten, the process is reversed.

The advantage to the modified bobble head container 100 is that its bobble head portion is somewhat simpler in construction than that of the bobble head container 10. The disadvantage is that the lower half 106 tends to provide a smaller capacity for the substance 16. Also, the lid 22 is hidden when it is disposed under the bobble head 12, and this adds to the realism of the figurine.

Clearly, many modifications are possible. For example, wherever screw threads are used, a snap type of a modified lid or engagement can be used. Many other modifications to the bobble head 12 are anticipated.

It is important to note that the container 14 and the modified fluid container 102 are intended to remain, primarily, in a level attitude with respect to a ground surface while the bobble head 12 is attached prior to use or consumption of the substance 16.

This provides a significant benefit in that the bobble head 12 (or bobble head portion of the modified fluid container 102) cannot strike the mouth of the user. The bobble head (or bobble head portion of the modified fluid container 102) must be removed to allow access to the opening in order to consume the substance 16. This makes the apparatus safer to use and more friendly because the bobble head 12 portion cannot cause a sudden jolt to the user.

Figure 4:
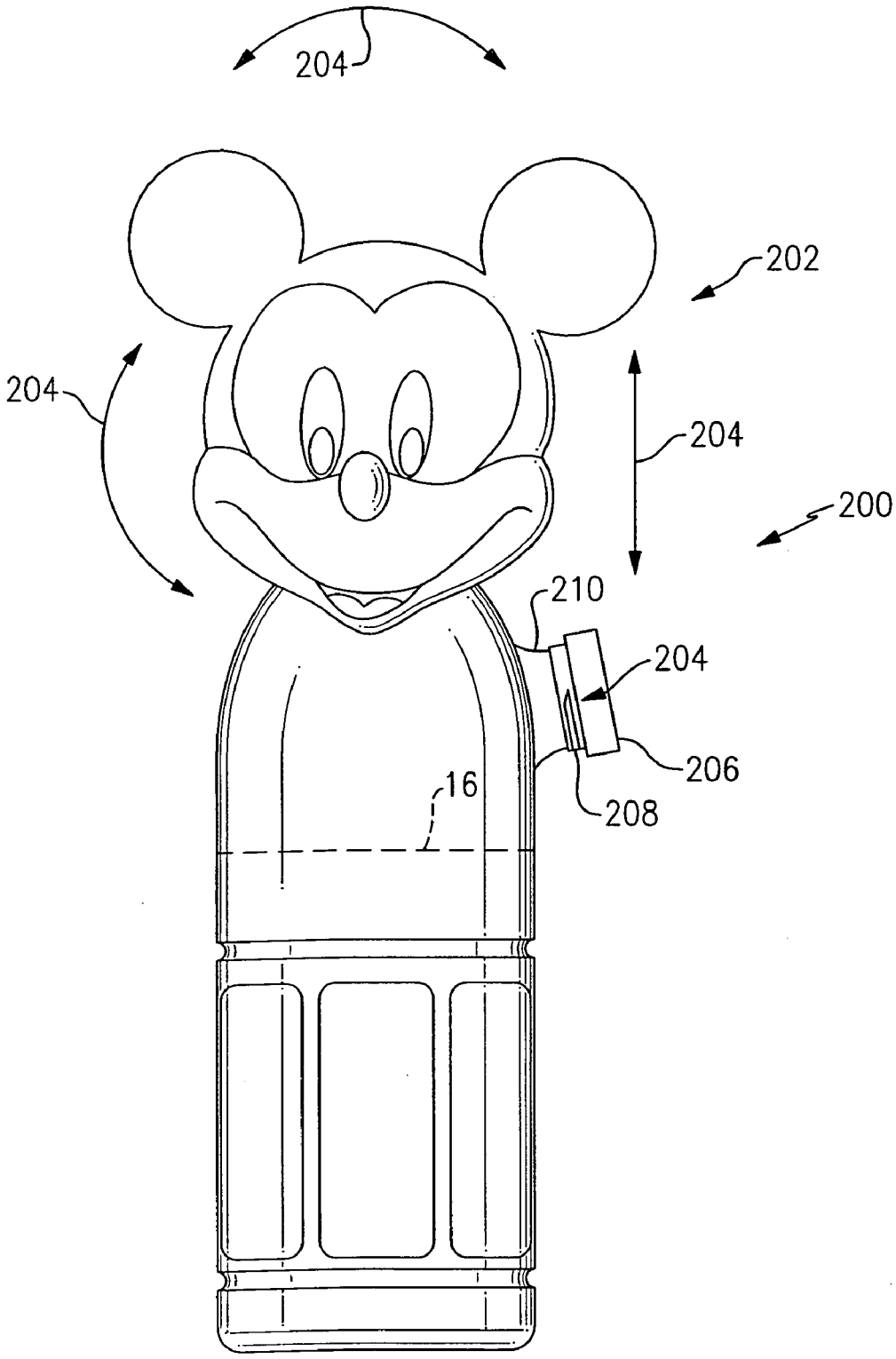
FIG. 4 is a side view of a second modified bobble head container, shown partially in cross-section that includes a separate opening.

Referring now to FIG. 4, a second modified bobble head container, identified in general by the reference numeral 200, is shown.

The second modified bobble head container 200 includes a modified bobble head 202 that is attached to a top of the second modified bobble head container 200. The modified bobble head 202 can be attached in any desired way providing it is capable of some movement in each of the directions shown by arrows 204.

The modified bobble head 202 includes a replica of a head of some sort of creature, either real or imagined, or any other ornamental design that is preferred. The modified bobble head 202 is not designed to be removable apart from the second modified bobble head container 200. This allows various design options for manufacturing the second modified bobble head container 200 at lower cost than designs that include a removable bobble head.

A separate opening, identified in general by the reference numeral 204, is shown under a screw on lid 206. The screw on lid 206 mates with screw threads 208 that are provided on an extended portion 210 of the second modified bobble head container 200.

To fill the second modified bobble head container 200, the screw on lid 206 is removed and the substance 16 is added through the separate opening 204 until the second modified bobble head container 200 is sufficiently filled. Then the screw on lid 206 is sufficiently tightened. To drain or consume the substance 16, the screw on lid 206 is removed and the second modified bobble head container 200 is tilted so that the substance 16 drains out of the extended portion 210 and out of the separate opening 204 and where desired or into a mouth of a user if the substance 16 is to be consumed. The second modified bobble head container 200 can be washed and re-used, as desired.

It is also anticipated that either the bobble head container 10, the modified bobble head container 100, or the second modified bobble head container 200 can be filled with the substance 16, if desired, by either the manufacturer or a value added manufacturer prior to purchase by the end user (i.e., the consumer of the substance 16).

The value added manufacturer would purchase the containers 10, 100, 200 and fill them with the substance 16 of choice prior to sale. This could include any desired beverage, for example, soda, milk, or juice. The value added retailer could also include any retail outlet store, including fast food stores that use the containers 10, 100, 200 to hold the beverages that they sell. The containers 10, 100, 200 can include information useful to promote the value added manufacturer, for example, their name and logo.

It is anticipated that the value added manufacturer would include some sort of safety indication that would assure the consumer (end user) that the substance 16 contents had not been tampered with. This could include an adhesive seal (not shown) over the separate opening 204 that must also be removed after the screw on lid 206 has been removed to gain access to the substance 16. If the adhesive seal has been tampered with, the consumer would not drink the substance 16.

Other possibly safety measures include the use of pull tabs or pull rings (not shown) that must first be broken and removed before the screw on lid 206 can be removed. If the pull tabs or pull rings are already broken, this indicates tampering and the substance 16 would similarly not be consumed.

Of course, the substance 16 added could be anything as was previously described, whether for human consumption or not.

Figure 5A:
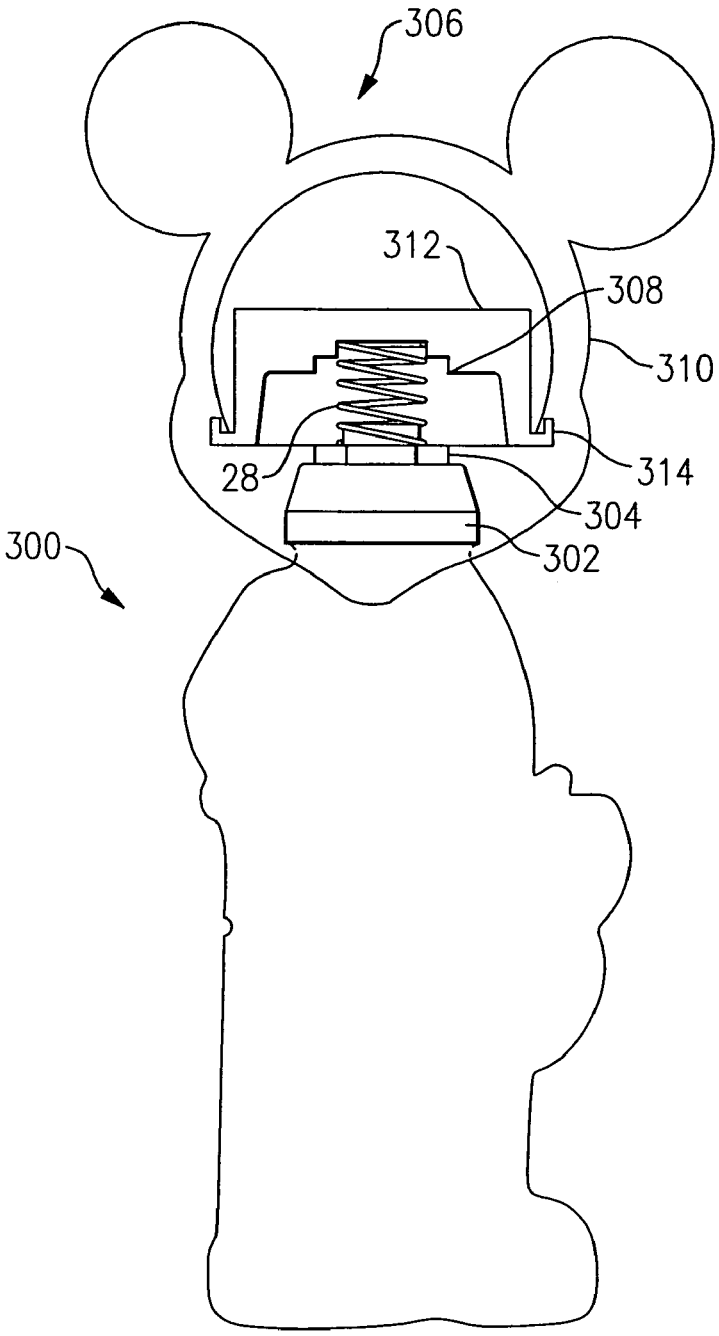
FIGS. 5*a*, 5*b*, and 5*c* include views of a third modified bobble head container, shown partially in cross-section that includes a hex key shape.
Figure 5C:
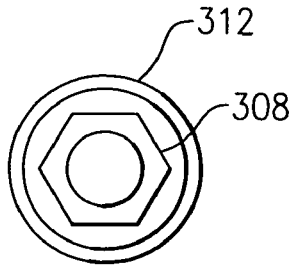
Figure 5B:
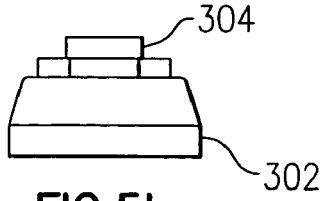

Referring now to FIGS. 5*a*, 5*b*, and 5*c* is shown a third modified bobble head container, identified in general by the reference numeral 300. The third modified bobble head container 300 includes a third modified container top 302 that includes a hex shape key 304 on top. Any shape can be used.

A third modified bobble head, identified by the reference numeral 306 is similar to that previously described and it includes a hex key recess 308 that is adapted to fit over the hex shape key 304 when the third modified bobble head 306 is pressed down, in a manner similar to that as was previously described. The third modified bobble head 306 is then rotated to loosen or tighten the third modified container top 302, which is secured by threads to the third modified bobble head container 300.

Preferably, the third modified bobble head 306 includes a decorative top 310 that is selected from one of many possible similar decorative tops, each one having a different ornamental appearance. A third modified support member 312 that includes the hex key recess 30, includes a circular ridge 314 that can accept any style of the decorative top 310. This allows widespread use of the third modified support member 312. This enhancement (use of the ridge 314) is also applicable for use with any of the embodiments previously described.

Figure 6A:
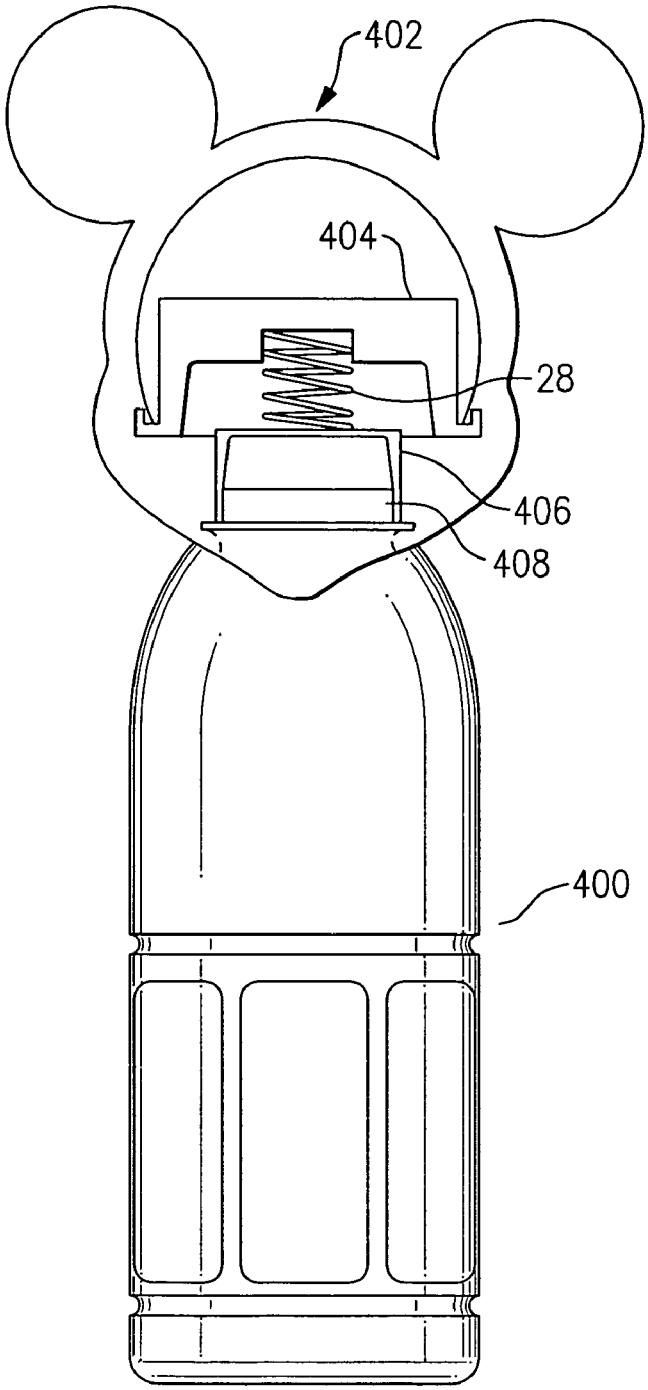
FIGS. 6*a* and 6*b* include side views of a fourth modified bobble head container, shown partially in cross-section that includes a sleeve which is adapted to fit over a pre-existing cap.
Figure 6B:
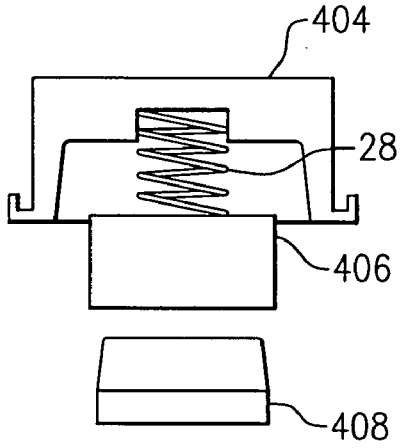

Referring now to FIGS. 6*a* and 6*b* is shown a fourth modified container 400 and a fourth modified bobble head, identified in general by the reference numeral 402.

A top of the spring 28 is attached to a fourth modified support member 404. The fourth modified support member 404 is similar to the previously described third modified support member 312.

A bottom of the spring 28 is attached to a top surface of a sleeve 406 by any preferred method. The top of the sleeve 406 can, if desired, include the first cylindrical extension 48 that was molded on top of the lid 22 as was previously described.

The sleeve 406 is open at the bottom and is adapted to slide over a pre-existing cap 408. The pre-existing cap 408 is typically a screw-on type and is found on any product. For example, the fourth modified container 400 can include any beverage or any other type of a product, as desired.

The sleeve 406 is designed to include a material and an inner diameter that fits snugly over the pre-existing cap 408. A friction fit intermediate the interior of the sleeve 406 and the pre-existing cap 408 arises when the fourth modified bobble head 402 is pressed down over the fourth container 400 after having first aligned the sleeve 406 over the pre-existing cap 408. The sleeve 406 is pressed down until an inside of the top surface of the sleeve 406 makes contact with a top of the pre-existing cap 408.

Air typically finds egress around the pre-existing cap 408. If not, vent holes can be provided in the top of the sleeve 406, as desired.

The fourth modified bobble head 402 is now secured to the fourth container 400, adding additional enjoyment and amusement.

When it is desired to open the fourth container 400, the fourth modified bobble head 402 is pulled up to separate the sleeve 406 apart from the pre-existing cap 408, which is then opened and closed normally.

This provides a method to use the fourth modified bobble head 402 with any pre-existing product that includes the pre-existing cap 408. Of course, any type of a pre-existing lid can be substituted for use as the pre-existing cap 408.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A bobble head container, comprising:

(a) a container for holding a quantity of a substance therein having a hollow interior and an opening for filling said container;

(b) a spring including a lower end thereof that is secured to an upper end of said container;

(c) an ornamental design that is secured to an upper end of said spring; and (d) means for detachably sealing said opening sufficient to prevent said substance from passing through said opening when said means for detachably sealing is engaged and wherein when said means for detachably sealing is not engaged, said substance is able to pass through said opening.

2. The bobble head container of claim 1 including a lid, wherein said lower end of said spring is secured to said lid.

3. The bobble head container of claim 2 wherein said lid is detachably-attachable to said container and wherein said lid includes said means for detachably sealing said opening.

4. The bobble head container of claim 3 wherein said lid includes screw threads and wherein said container includes corresponding screw threads disposed around said opening, and wherein said corresponding screw threads are adapted for mating with said screw threads of said lid.

5. The bobble head container of claim 2 including a support member disposed in said bobble head, said support member secured to an upper end of said spring.

6. The bobble head container of claim 5 wherein said lid includes tapered sides wherein a top of said lid includes a smaller diameter than a bottom of said lid and wherein said tapered sides include a plurality of first longitudinal alternating protrusions and recesses disposed around an outer circumference of said lid and wherein said support member includes a recess that includes interior tapered sides and wherein said recess includes a shape substantially that of a frustum of a cone and wherein said interior tapered sides include a plurality of second longitudinal alternating protrusions and recesses disposed around an inner circumference of said recess wherein said plurality of first longitudinal alternating protrusions and recesses are adapted to engage with said plurality of second longitudinal alternating protrusions and recesses when a force is applied to said bobble head to urge said bobble head down toward said lid sufficient to compress said spring and to allow said alternating first and second protrusions and recesses to mesh together.

7. The bobble head container of claim 6 wherein when said plurality of first longitudinal alternating protrusions and recesses engage with said plurality of second longitudinal alternating protrusions and recesses, as said bobble head is rotated in either a clockwise or counterclockwise direction about a vertical center longitudinal axis, said lid is adapted to tighten on said container or loosen, respectively.

8. The bobble head container of claim 7 wherein when said bobble head is rotated sufficiently far in a counterclockwise direction, said lid is disengaged from a position of cooperation with said container and wherein said bobble head, said support member, said spring, and said lid together form an assembly that can be removed from said container sufficiently far to provide access to said opening in said container.

9. The bobble head container of claim 1 wherein said container includes a lower half and an upper half, and wherein said opening is disposed in said lower half and including means for detachably-attaching said upper half to said lower half, and wherein said upper half includes a seal to prevent said substance from escaping from any part of said upper half when said upper half and said lower half are attached to each other.

10. The bobble head container of claim 9 wherein said means for detachably-attaching includes a first set of screw threads attached proximate a bottom of said upper half and a second set of corresponding screw threads attached to said lower half and wherein said second set of corresponding screw threads is disposed around said opening.

11. The bobble head container of claim 1 wherein said opening includes means for sealing said opening and wherein said bobble head includes means for engaging with said means for sealing sufficient to remove said means for sealing from said container.

12. The bobble head container of claim 11 wherein said means for sealing includes a lid having screw threads that are adapted to mate with corresponding screw threads that are disposed proximate said opening on said container and wherein said means for engaging includes providing a shape in a portion of said bobble head that is adapted to interlock with a corresponding shape that is provided in said lid and wherein said portion of said bobble head is adapted to be urged to engage with said corresponding shape in said lid sufficient to cause said lid to rotate when said bobble head is rotated.

13. The bobble head container of claim 12 wherein said shape and said corresponding shape include a hexagonal shape.

14. The bobble head container of claim 12 including a spring intermediate said bobble head and said lid.

15. A method for making a bobble head container, comprising the steps of:

(a) providing a container for holding a quantity of a substance therein having a hollow interior and an opening for filling said container;

(b) attaching a bobble head to said container, said bobble head including a shape that includes an ornamental design and wherein said bobble head is adapted to tilt in any direction along a three hundred and sixty degree arc around a longitudinal vertical axis passing through said bobble head; and (c) providing means for sealing said opening sufficient to prevent said substance from passing through said opening when said means for sealing is engaged and wherein when said means for sealing is not engaged, said substance is able to pass through said opening.

16. The method for making a bobble head container of claim 15 wherein the step of providing means for sealing includes providing means for removing said means for sealing sufficient to access said opening.

* * * * *